United States Patent [19]

Conquest

[11] 4,358,704

[45] Nov. 9, 1982

[54] HELIX TRAVELING WAVE TUBES WITH REDUCED GAIN VARIATION

[75] Inventor: Ernest A. Conquest, Mountain View, Calif.

[73] Assignee: Varian Associates, Inc., Palo Alto, Calif.

[21] Appl. No.: 183,541

[22] Filed: Sep. 2, 1980

[51] Int. Cl.[3] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 3,433,999 | 3/1969 | Espinosa | 315/3.5 |
| 3,437,866 | 4/1969 | Hentschel | 315/3.5 |
| 3,510,720 | 5/1970 | Putz | 315/3.5 |
| 3,538,377 | 11/1970 | Slocum | 315/3.6 |
| 3,832,593 | 8/1974 | Gross | 315/3.6 |
| 4,158,791 | 6/1979 | Lien et al. | 315/3.6 |
| 4,282,457 | 8/1981 | Harper | 315/3.6 |
| 4,292,567 | 9/1981 | Fritchle et al. | 315/3.6 |
| 4,296,354 | 10/1981 | Neubauer | 315/3.6 |

FOREIGN PATENT DOCUMENTS

| | | | |
|---|---|---|---|
| 779583 | 7/1957 | United Kingdom | 315/3.5 |
| 1442706 | 1/1976 | United Kingdom | 315/3.5 |

*Primary Examiner*—Saxfield Chatmon, Jr.
*Attorney, Agent, or Firm*—Stanley Z. Cole; Keiichi Nishimura

[57] ABSTRACT

In a traveling wave tube (TWT) using an interaction circuit of the helix-derived type, the gain of the tube normally varies significantly over the passband. The invention provides a simple method of reducing the gain variation together with a reduction in the noise power density produced at the output of the tube. This is accomplished by affixing a nonresonant terminated transmission line such as a meander line on at least one of the dielectric rods used to support the helix.

24 Claims, 6 Drawing Figures

10
12
13
14
15
16
18
20
22
24
26
28
29
30
32
34
36
38
40
42
44
46
50
51
53
54
2
2

67
68
69
SMALL SIGNAL GAIN
FREQUENCY 64
65
PHASE VELOCITY
FREQUENCY 32
34
30
40
42
50
32
32

30'
34
32
50'
52
32
32

32''
51''
56

HELIX TRAVELING WAVE TUBES WITH REDUCED GAIN VARIATION

DESCRIPTION

1. Field of the Invention

The invention relates to traveling wave tubes (TWT's) using interaction circuits of the helix-derived type. More particularly, it relates to the equalization of gain variation over the wide frequency band of such tubes.

2. Background of the Invention

It has been known to reduce the gain variation with frequency in wide-band TWTs by incorporating an attenuator in the signal transmission line. U.S. Pat. No. 3,548,344 issued Dec. 15, 1970, No. 3,510,720 issued May 5, 1950 and No. 3,414,844 issued Dec. 3, 1968, all to J. L. Putz and the former two assigned to the assignee of the present invention illustrate such gain equalizers using resonant circuits or the frequency sensitive properties of transmission lines. These equalizers which are generally connected in series at the input to the TWT externally to the tube's vacuum envelope are expensive to manufacture, besides being disadvantageous from the point of view of the noise power density produced at the output of the tube. Since the signal is attenuated before it is amplified, such gain equalizer-amplifier combinations are incapable of influencing the noise power density at the tube's output although they can successfully reduce the net gain variation. This technique may further cause the input voltage standing-wave ratio of the combination to be worse than that of the tube alone and generally causes an increase in the amplifier gain slope or ripple amplitude.

Non-gain equalizing devices for wave attenuation which are to be placed inside TWT's, on the other hand, have been illustrated for example by U.S. Pat. No. 4,158,791 issued June 19, 1979 to E. L. Lien and A. W. Scott and assigned to the assignee of the present invention, U.S. Pat. No. 3,368,103 issued Feb. 6, 1968 to E. S. Thall and U.S. Pat. No. 3,397,339 issued Aug. 13, 1963 to W. L. Beaver. These inventions range from the fastening of a plurality of metal strips or loss attenuator strips in the vicinity of the helix through the use of a resistive element comprising a discontinuous conductive layer between the helix and the support rods, and further to the use of loss attenuators made resonant at a frequency where the phase shift is 180 degrees per helix turn. All of these, however, were primarily addressed to the problems which arise with the instabilities and oscillations at frequencies near the band edges of the circuit where the wave group velocity becomes very small and the interaction impedance correspondingly large. For this reason, these devices were designed to minimize the loss of circuit energy within the pass-band and this required the resultant attenuation to be selectively dependent on frequency, having a relatively narrow resonance characteristic. Thus, they were unsuitable as gain equalizers.

SUMMARY OF THE INVENTION

An object of the invention is to provide a helix-type TWT with reduced gain variation with frequency.

A further object is to provide a gain equalizer for a helix-type TWT incorporated within the tube structure.

A further object is to provide a gain equalizer for a helix-type TWT which reduces the noise power density produced at the output of the tube.

The above objectives are achieved by providing within the vacuum envelope of a helix-type TWT a terminated non-resonant slow wave equalizing transmission line which will couple energy to or from the interaction circuit (helix) and absorb energy from it in a frequency selective manner. A convenient way of applying this technique is to deposit by photoetching or other method a meander-type transmission line on one or more of the dielectric support rods used to mount the tube's interaction circuit within the vacuum envelope, each of the meander-type transmission lines terminated in such a way as to be made reflectionless, for example, by depositing pyrolytic carbon at each end.

DETAILED DESCRIPTION OF THE INVENTION

Figure 1:
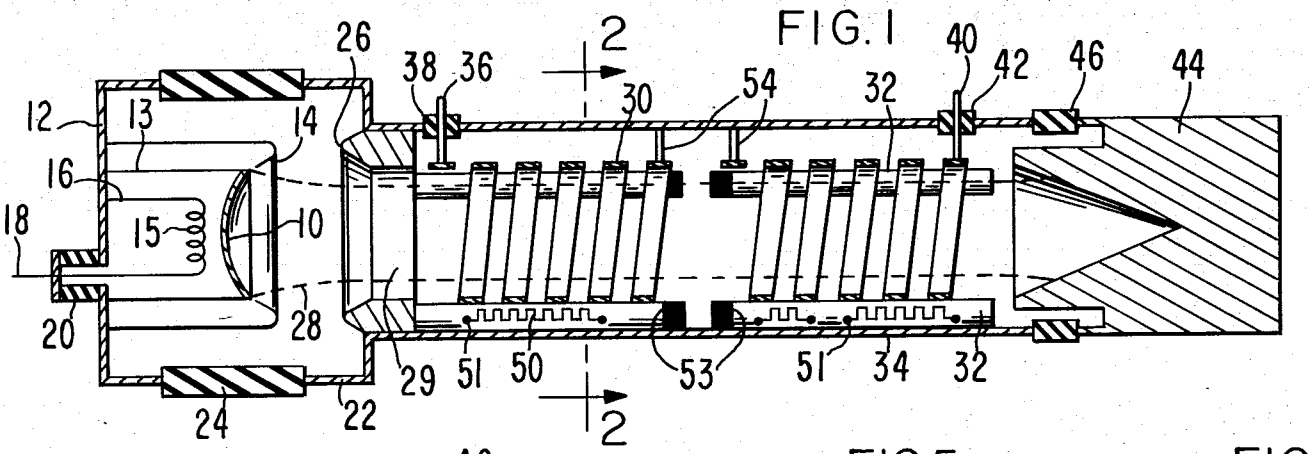
FIG. 1 is a schematic section through the axis of a TWT using a helix circuit.
Figure 2:
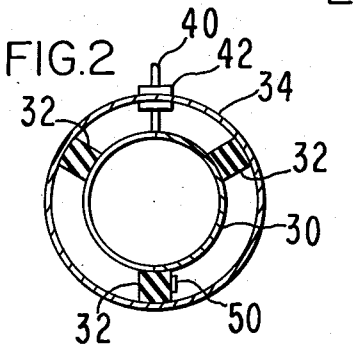
FIG. 2 is a section perpendicular to the axis of the TWT of FIG. 1.

FIG. 1 is a simplified schematic section of a TWT incorporating the present invention. A beam of electrons is drawn from thermionic cathode 10 such as a conventional impregnated tungsten cathode. Cathode 10 is typically of concave circular shape supported on a base 12 by an electrically conducting but thermally isolating support member 13. Surrounding cathode 10 is a beam focus electrode 14, also supported on base 12. Cathode 10 is heated by radiation from a filamentary heater 15, typically tungsten wire insulated with an alumina coating. One leg 16 of heater 15 is joined to base 12, and the other leg 18 is brought out through the vacuum envelope for external connection via an insulating seal 20. Base 12 is sealed to the main vacuum envelope 22 by a high voltage insulator 24. Inside envelope 22 a projecting anode electrode 26 operated at a dc potential positive to cathode 10 draws the electron beam 28 from cathode 10, converging it through an aperture 29 in anode 26 and projecting it as a cylindrical beam. Beyond anode 26 the beam 28 is typically kept focused by an axial magnetic field produced by a solenoid or a permanent magnet system (not shown). Beam 28 passes inside a slow-wave interaction circuit 30 which is designed to propagate an electron magnetic wave at a velocity nearly synchronous with the velocity of the electron beam 28. Circuit 30 may be a metallic wire or tape of rectangular crosssection wound into a helix. It may further be separated into two segments (as illustrated by FIG. 1) or more. Circuit 30 is supported along its length by a plurality of axially extending dielectric rods 32, as of pyrolytically deposited boron nitride or alumina ceramic. The support may be purely mechanical containment or alternatively rods 32 may be joined to circuit 30 by glazing or brazing. Support rods 32 are mechanically contained inside a cylindrical portion 34 of the vacuum envelope. Support rods 32 may be circular cylinders, suitable for low-power TWT's, or in high-power tubes may, as shown in FIG. 2, have a generally rectangular cross-section with outer surfaces curved to fit the helix and the tube envelope for improved thermal conduction. The ends of helix 30 are connected to external transmission lines by metallic pins 36, 40 welded to the ends of helix 30 and extending through vacuum envelope 34 via insulating dielectric seals 38, 42. In a forward wave TWT amplifier, the input signal would be applied to input terminal 36 and the amplified output would be removed through output terminal 40. If helix 30 is divided into segments, as shown in FIG. 1, the ends not connected to input terminal 36 or output terminal 40 are connected to vacuum envelope 34 through metal straps 54 or by any suitable means. In such a case, support rods 32 are also severed into corresponding segments, the severed end of these segments being made reflectionless, for example, by placing thereon a deposit of lossy substance 53. After leaving helix 30, electron beam 28 enters a hollow metallic collector 44 and the current is removed by an external power supply (not shown). Collector 44 is mounted on envelope 34 via a dielectric vacuum seal 46, as of alumina ceramic, thereby completing the vacuum envelope.

On at least one of support rods 32 is a nonresonant slow wave equalizing transmission line. As illustrated in FIG. 1, support rods 32 are not prevented from carrying two or more equalizing transmission lines each. In FIG. 1, furthermore, equalizing transmission lines are illustrated as meander lines 50 formed of strips of conductor which are affixed to the surface of support rod 32 and terminated at each end in a deposit 51 of a lossy film such as pyrolytic carbon. A convenient way of applying this technique is to deposit a conductive material and form the meander line by photoetching technique. The pitch of the meander line and its proximity to the interaction circuit 30 are adjusted so that its phase velocity, dispersion, and coupling factor will have suitable values as will be discussed more fully in what follows.

In FIG. 2, equalizing transmission line 50 is shown as lying on the surface of a dielectric support rod 32.

Figure 3:
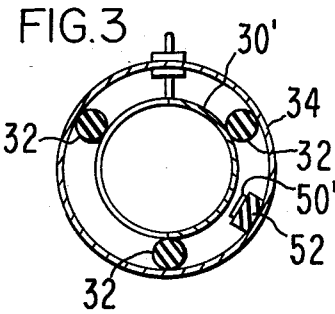
FIG. 3 is a section similar to FIG. 2 illustrating an alternative embodiment of the invention.

FIG. 3 illustrates an alternative embodiment in which the equalizing transmission line 50' is supported on an independent dielectric support rod 52 which in turn is supported inside envelope 34. This construction is advantageous in that the area of surface supporting the transmission line 50' can be made larger and that the transmission line 50' can be placed more closely to the helix 30'.

Figure 4:
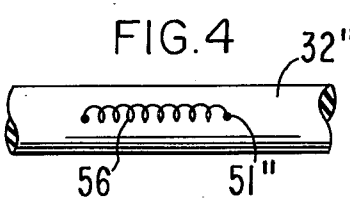
FIG. 4 is an enlarged section of a portion of a TWT similar to FIG. 1 with an alternative type of transmission line.

FIG. 4 shows an alternative embodiment of the equalizing transmission line 56. Here, a small metallic helix, as of tungsten wire, is affixed to support rod 32'' as by glazing. The slow-wave helix circuit 56 is made reflectionless, for example, by a deposit of pyrolytic carbon 51'' at each end.

Figure 6:
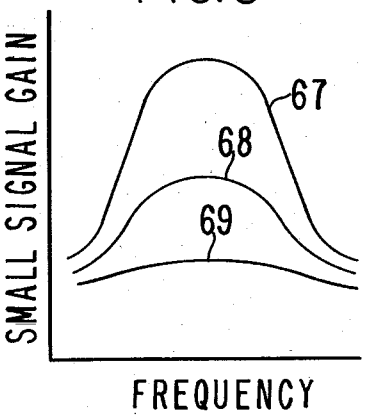
FIG. 6 is an illustration of typical small signal gain and attenuation of the device of the invention together with the resultant equalized gain as functions of frequency.
Figure 5:
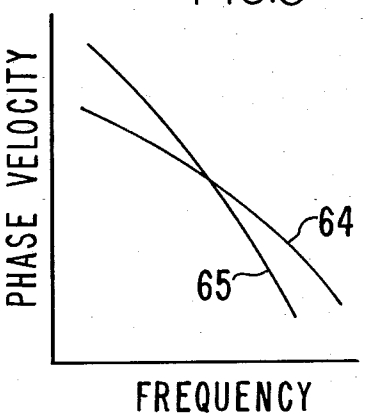
FIG. 5 is an illustration of typical curves of the phase velocities of the circuit of the preferred form of the device of the invention.

The principles involved in the equalization of gain variation are now explained by means of FIGS. 5 and 6. In FIG. 5, a typical example of the dispersion relation, i.e., the functional relationship between the phase velocity and frequency, of interaction circuit 30 is illustrated by curve 64. In the case of a non-dispersive circuit, the curve would naturally be horizontal and straight. Curve 65 shows an example of the dispersion relation of a non-resonant transmission line such as 50 of FIG. 1.

For the purpose of equalizing the gain variation, the transmission lines 50 are adjusted in view of the performance characteristics of the interaction circuit 30 so that the two curves 64 and 65 cross each other within the passband of the interaction circuit 30, or near the center thereof. The crossing point determines the frequency at which the coupling is the strongest between the interaction circuit 30 and the transmission line 50. The coupling is typically made to the operating mode or to the fundamental mode for the purpose of equalizing the gain variation. Thus, the coupling is made in a frequency selective manner and energy is generally coupled from the main transmission line at low frequencies and is absorbed in the coupled line termination 51 while at high frequencies the coupled-off signals are returned to the main transmission line, thereby not reducing the gain at the high band-edge.

A typical consequence of such adjustment is illustrated in FIG. 6. Curve 67 therein represents a typical frequency-dependence of the small signal gain without equalizing while curve 68 represents attenuation resulting from the signal coupled onto the equalizing transmission line 50. Curve 69 is the resultant or net small signal gain of the self-equalized TWT. The substantial reduction in gain variation over a wide frequency range is to be noted.

It will be obvious to those skilled in the art that that many other embodiments of the invention are possible within its true inventive scope. For example, there are several forms of helix-derived slow-wave interaction circuits which would be suitable such as the ring-loop or cross-wound helix, multiple-pitch helices, etc. The non-resonant equalizing transmission line can be of a wide diversity of types and it can be deposited by any of the well-known methods of depositing a metallized pattern on a ceramic body. In certain circumstances, for example, where the compactness of the device may be sacrificed, transmission line 50 may be placed outside vacuum envelope 34, if the envelope is not metallic. The scope of the invention is intended to be defined only by the following claims.

I claim:

1. A traveling wave tube with a reduced gain variation over the passband comprising a helix-type interaction circuit, an elongated dielectric member, and a non-resonant coupled slow-wave equalizing transmission line affixed to said elongated dielectric member.

2. The tube of claim 1 wherein said transmission line is terminated.

3. The tube of claim 1 or 2 wherein said transmission line is adapted to interact with said interaction circuit to absorb energy from and return energy to said interaction circuit in a frequency-selective manner.

4. The tube of claim 1 or 2 wherein said transmission line and said elongated dielectric member extend in the axial direction of said tube.

5. The tube of claim 1 wherein said transmission line is shaped as a meander line.

6. The tube of claim 5 wherein said meander line is a metallized pattern on said elongated dielectric member.

7. The tube of claim 5 wherein the material for said meander line is deposited and said meander line is formed by photoetching technique.

8. The tube of claim 2 wherein said transmission line is reflectionless.

9. The tube of claim 2 further comprising a pyrolytic carbon deposit at each end of said terminated transmission line.

10. The tube of claim 1 wherein said elongated dielectric member supports said helix-type interaction circuit.

11. The tube of claim 1 further comprising a vacuum envelope, said elongated dielectric member being positioned inside said vacuum envelope.

12. The tube of claim 11 wherein said vacuum envelope is metallic.

13. The tube of claim 11 wherein the interior of said envelope is a right circular cylinder.

14. The tube of claim 11 wherein said transmission line is affixed to said elongated dielectric member insulated from said envelope.

15. The tube of claim 3 wherein both said interaction circuit and said transmission line are dispersive.

16. The tube of claim 15 wherein said interaction circuit and said transmission line have a maximum coupling frequency within the passband of said tube.

17. In combination:

a vacuum envelope;

a helix-type interaction circuit within said envelope; and means including a non-resonant transmission line adjacent said interaction circuit for coupling from said interaction circuit and absorbing said energy energy in a frequency-selective manner.

18. The combination of claim 17 wherein both said interaction circuit and said transmission line are dispersive.

19. The combination of claim 17 or 18 wherein said transmission line is terminated.

20. The combination of claim 17 or 18 wherein the coupling characteristics between said interaction circuit and said transmission line are so adjusted that the phase velocities of said interaction circuit and said transmission line are equal near the mid-frequency of the operating band of said interaction circuit and different at other frequencies in said operating band.

21. The combination of claim 17 wherein said transmission line is inside said vacuum envelope.

22. The combination of claim 17 wherein said envelope is metallic.

23. A traveling wave tube comprising:

a helix-type slow wave interaction circuit for interaction with a linear electron beam over a selected band of frequencies,.

a dielectric member adjacent said circuit extending in the direction of said beam, and a non-resonant terminated transmission line associated with said dielectric member in coupled relationship to said interaction circuit to attenuate selected lower frequencies in said band while not affecting high frequencies, whereby tube gain over said band of frequencies is equalized.

24. A method of reducing gain variation of a traveling wave tube having a helix-type interaction circuit not coupled to any resonant circuit within a same vacuum envelope, said method comprising the step of providing an elongated dielectric member adjacent said interaction circuit and one or more non-resonant coupled slow-wave equalizing transmission lines affixed to said dielectric member.

* * * * *